United States Patent [19]

Morales

[11] 3,959,680

[45] May 25, 1976

[54] PHOTOMULTIPLIER TUBE HAVING A PLURALITY OF SENSING AREAS

[75] Inventor: John J. Morales, Huntington, Conn.

[73] Assignee: S.R.C. Laboratories, Inc., Fairfield, Conn.

[22] Filed: Jan. 24, 1975

[21] Appl. No.: 544,016

[52] U.S. Cl. ..... 313/95; 313/96; 250/207

[51] Int. Cl.[2] ..... H01J 39/06; H01J 39/02

[58] Field of Search ..... 313/95, 96; 250/207

[56] References Cited

UNITED STATES PATENTS

| | | | |
|---|---|---|---|
| 2,133,132 | 10/1938 | Clamann | 313/95 X |
| 2,431,510 | 11/1947 | Salinger | 313/95 X |
| 2,433,700 | 12/1947 | Larson | 313/95 X |
| 2,433,724 | 12/1947 | Wolfgang | 313/95 |
| 2,575,769 | 11/1951 | Rajchman et al. | 313/95 X |
| 2,945,144 | 7/1960 | Schmidt et al. | 313/95 |
| 3,207,997 | 9/1965 | Eberhardt | 313/95 X |

*Primary Examiner*—Robert Segal
*Attorney, Agent, or Firm*—Ernest M. Junkins

[57] ABSTRACT

A single photomultiplier tube having four sensing areas each of which produces its own independent electrical signal that is related to the quantity of sensed matter that impinges on its area.

24 Claims, 20 Drawing Figures

10
11
12
13
14
15
16
17
18
19
20
21
22
23
24
25
26
27
27a
28
29
30
31
32
33
34
35
36
38
38a
39

PHOTOMULTIPLIER TUBE HAVING A PLURALITY OF SENSING AREAS

The present invention relates to photomultiplier tubes that provide an electrical signal whose value is related to the quantity of sensed matter (such as rays or particles) that impinge on its sensing area. In some applications, the sensed matter appears over quite a large surface and it is desired to obtain an electrical indication that portrays the concentration and location of the sensed matter on the large surface. Heretofore, a plurality of photomultiplier tubes had their sensing areas located at the large surface and each tube produced an electrical signal of the sensed matter that occured in its own specific area of the large surface.

In some instances where it is desired to increase the resolution of the electrical portrayal, it has been suggested that each tube be made smaller to have a smaller sensing area, thereby providing a greater quantity of electrical indications. While this may be feasible in some devices, in others it has not been found to be completely satisfactory. Some disadvantages appear to include difficulties in mechanically positioning and connecting a large number of small tubes, a substantial increase in cost of a system as the number of tubes increased, the cost and difficulty in converting present tube-using systems to smaller size tubes, the cost of developing and manufacturing a new size tube, etc.

It is accordingly an object of the present invention to provide a single photomultiplier tube that while retaining essentially the same exterior size as heretofore known tubes, is capable of sensing a plurality of small size areas and providing an independent electrical signal for each small area with each area having essentially the same electrical response characteristics.

Another object of the present invention is to achieve the above object with a plural sensing area photomultiplier tube which is relatively economical to manufacture, in which a number of components of a similar size, single sensing area tube is utilized and in which substantially the same manufacturing operations for single area tubes are followed.

A further object of the present invention is to provide a plural sensing area photomultiplier tube which is readily susceptible to economical use in tube containing systems.

Still another object of the present invention is to achieve the above objects with a single photomultiplier tube that senses a plurality of areas in which overlapping or loss of sensed information between areas is within acceptable limits even though the information for each area is not completely physically isolated from the other areas.

Another object is to provide a dynode for a photomultiplier tube that utilizes slats formed on concentric frustums of cones.

The photomultiplier tube of the present invention has the usual configuration of such tubes in that there is a cylindrical glass envelope which is preferably of the heretofore known size for a single area tube and includes a base or stem header having electrical connections. The envelope has a flat face sensing area, the interior of which is coated with a photocathode material that is responsive to the material being sensed and then proceeding axially toward the stem header, an axially elongate chamber, a plurality of axially spaced dynodes stacked along the axis and finally a collector or anode to which electrical connections are made to obtain the electrical signals. Thus, a sensed particle or ray which strikes the sensing area causes the emission of electrons in the chamber from the photocathode material, which electrons are sequentially attracted and multiplied by each succeeding dynode with the anode measuring, as the electrical signal, the quantity of electrons attracted to it.

For subdividing such a tube into a plural sensing area tube, Applicant developed the concept of having the tube elements be essentially divided into the same number of portions as there are sensing areas. The portions for each area are made to be aligned along the axis of the tube and the electron flow for each area is made to proceed from its sensing area to its anode basically only in its own portions of the elements. In the specific embodiment herein described there are four independent sensing areas and hence the tube elements are divided into four equal portions which, as the envelope is cylindrical, causes each essentially to be shaped as a quadrant having its apex aligned with the tube axis. Accordingly, the chamber is provided with a pair of walls that mechanically divide it into four separate, elongate chambers each with a quadrant of the tube's sensing face. The dynodes are herein of the venetian blind type having the usual parallel, rectangular slats except that the first dynode is made to have spaced concentric frusto-conical slats.

The electron flow of an area is essentially contained within its portion by each dynode having crossed barriers which tend to direct the flow from one portion of one dynode to the same portion in the next dynode. Moreover, the parallel slat dynodes are only sequentially shifted 90° in slat orientation instead of the usual 180°. The anode consists of four separate portions positioned adjacent the stem header with each portion attracting thereto basically the electrons only in its own area. An electrical connection is made to each anode portion for providing an electrical indication of the quantity of electrons that are attracted to each portion.

Other features and advantages will hereinafter appear.

Figures 1, 2, 3, 4, 5, 6, 7, 8, 9:
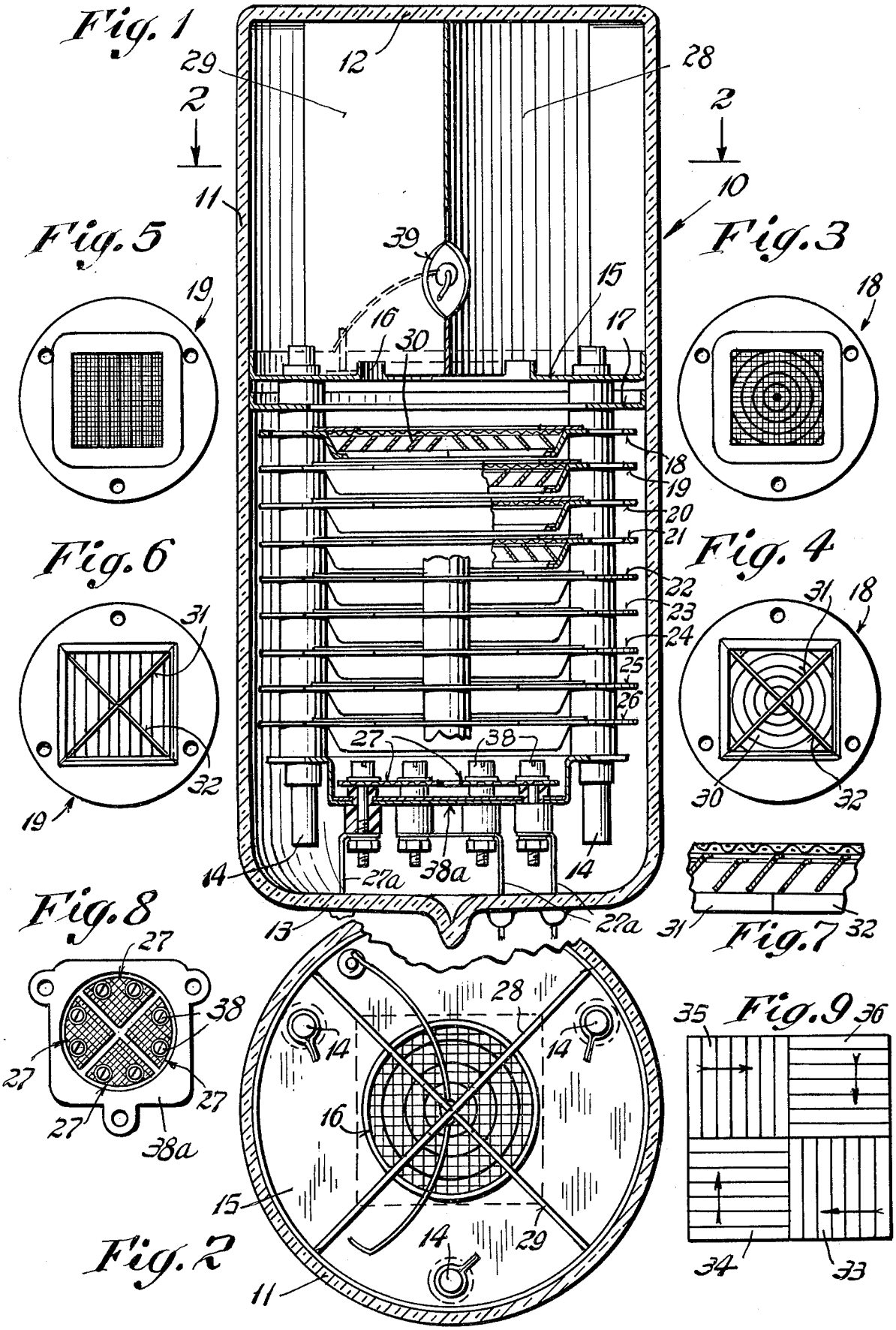
FIG. 1 is a view of an axial length of the tube of the present invention with portions being shown in cross-section or broken away for clarity of illustration.
FIG. 2 is a view taken on the line 2—2 of FIG. 1.
FIG. 3 is a top view of the first dynode.
FIG. 4 is a bottom view of the first dynode.
FIG. 5 is a top view of one of the parallel slat dynodes.
FIG. 6 is a bottom view thereof showing one form of crossed barriers.
FIG. 7 is a vertical section of a portion of a parallel slat dynode.
FIG. 8 is a top view of the anode.
FIG. 9 is a diagrammatic representation of the slat orientation.

Referring to the drawing, the plural sensing area photomultiplier tube of the present invention is generally indicated by the reference numeral 10 and includes an essentially cylindrical glass envelope 11 having a flat face 12 at its upper end and a stem header 13 closing its lower end. The stem header is only partially shown but is either formed of the same material as the envelope, generally glass, or may be a separate component which supports electrical connectors, such as pins, but in any event the stem header and envelope are joined with a hermetic seal.

Extending upwardly from the stem header are a plurality of insulating posts 14, three being shown, which support a plurality of elements, the upper element being a metallic sheet metal annulus 15 having a central aperture 16. Positioned beneath the annulus is a spacing ring 17, then proceeding toward the stem header there are nine dynodes indicated by the reference numerals 18 through 26 with the reference numeral 18 indicating the first dynode. Adjacent the bottom of the tube is a collector or anode indicated by the reference numeral 27 with electrical conductors 27*a* being connected thereto. These conductors (as well as many others not shown) extend through the stem header with the junction therebetween being a hermetic seal as is known in the art. The above-noted construction is typical of a commercially available single sensing area photomultiplier tube.

In accordance with the present invention, the inner surface of the face 12 of the tube is formed into four separate sensing areas and an electrical signal having a value directly related to the quantity of rays or particles impinging on each area of the face 12 is provided on the conductors 27*a*. Accordingly, the tube 10 has a pair of perpendicularly disposed diametric walls 28 and 29 extending between the annulus 15 and the inner surface of the face 12. In view of the envelope being cylindrical and in view of there being desired to have four equal sensing areas, the walls intersect on the central axis of the tube and cause each sensing area to be a quadrant of a circle. With this construction, the walls 28 and 29 thus define four separate chambers each of which has its own outlet for electron flow through the aperture 16 to the dynodes. It will be understood that the chambers are elongate along the axis and thus basically cause the electrons that are present in each chamber to essentially flow through the aperture 16 on a line that is somewhat parallel with the axis of the tube so that they are basically divided when they encounter the first dynode 18.

The first dynode 18 is of the general classification of venetian blind or slat type but is herein formed of a plurality of concentric, frusto-conical elements 30. Electrons that engage this dynode and are multiplied tend to pass therethrough in a radially diverging manner to thus basically stay within their own portion of the tube that is aligned with their chamber from which they were derived. As shown in FIG. 4, the underside of the first dynode has a pair of thin crossed barriers 31 and 32 which extend somewhat below the surface of the bottom of the dynode, parallel with the axis of the tube and which serve to decrease migration of electrons from one portion into another.

The remaining dynodes 19 through 26 are of the venetian blind, linear slat construction with each having a plurality of equally spaced, parallel slats which are inclined from their upper surface towards their lower surface. These dynodes are of conventional construction but each has the crossed barriers 31 and 32 added thereto on their underside.

The standard photomultiplier tube has the orientation of the slats generally changed 180° between successive dynodes. However, in accordance with the present invention, the orientation of the slats is rotated only 90° clockwise from an upper dynode towards the next lower dynode. Thus, as shown in FIG. 9, if the dynode 19 which is just beneath the first dynode 18 has its slats positioned according to the representation in the block 33 with the arrow being indicative of the direction of inclination of the slats, the next dynode 20 has its slats oriented in the position shown by a block 34 with the arrow also indicating the inclination. Similarly, the block 35 indicates the orientation of the slats of the dynode 21 and the block 36 of the orientation of the dynode slats 22. As there are eight dynodes of the venetian blind type, namely 19 to 26, in the specific embodiment shown, though a different number may be employed if desired, there are thus two dynodes 19 and 23 which have the same slat indication as shown in block 33 and so forth with respect to the remaining dynodes.

It will be noted that each of the dynodes including the first dynode 18 has a conventional grid positioned at their upper surface. Also it will be noted that the area of each dynode 19–26 occupied by the parallel slats is square which enables the slats to be positioned in accordance with the orientation described in connection with FIG. 9 without any significant basic change in the parts composing each dynode.

The bottom-most element supported by the posts 14 is a collector or anode which, as shown in FIG. 8, is of the grid type. It consists of four anode portions 27, each being quadrant shaped. One conductor 27*a* is connected to each anode to provide electrical connection thereto by the use of a pair of supports 38 that also serve to mechanically support their anode portion above the bottom of a support plate 38*a*. The grid portions have a space therebetween to provide for electrical separation.

With the above elements assembled within the tube and with the stem header hermetically sealed to the envelope, the envelope is evacuated and the surface of the chambers is coated with a photocathode material of the type that is sensitive to the energy being detected as is common in single sensing area photomultiplier tubes. It is desired that the inner surface of the face 12 be as evenly coated as possible so that the same electron emission will occur for identical impinging quantities of energy. In accordance with the present invention, even though the walls 28 and 29 divide this surface into the four separate sensing areas, an essentially constant coating is obtained by forming the walls to have an aperture 39 at their intersection. Photocathode material positioned within this aperture may be evaporated to condense essentially evenly on the surfaces by conventional techniques. The use of the aperture 39, which though rather small enables equal access to be had to each sensing surface from a central axial position, thereby assuring the somewhat even disposition of the photocathode material without blank spots.

The dynodes below the annulus 15, especially the slats and perhaps the barriers, are coated with an electron emissive material in the same manner as with a conventional photomultiplier tube.

The dynodes, as is well recognized in the art, are placed at different electric potentials and the number of wires therefor, while not shown, need only be the same number of wires that are required in a single sensing area tube for the dynodes. Each dynode is accordingly placed at the same potential throughout, which not only reduces the cost of manufacture, but assures that all the electrons from each sensing area will be subject, at least for that dynode, to the same potential.

Figure 10:
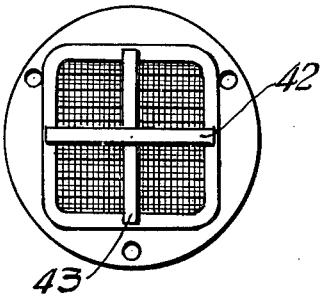
FIG. 10 is a plan of a parallel slat dynode showing another embodiment of the crossed barriers.
Figure 11:
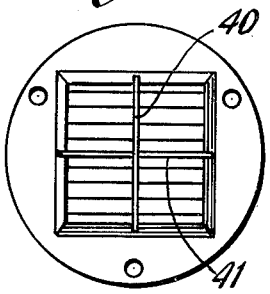
FIG. 11 is a view of a dynode showing a further embodiment of the crossed barriers.

The barriers 31 and 32 have been shown as thin strips of metal which have their width parallel with the axis of the tube. Alternatively, as shown in FIG. 11, the barriers 40 and 41 may be formed by lengths of round metal wire. Further, barriers 42 and 43, shown in FIG. 10, may be placed on the top side of each linear slat dynode with their width being perpendicular to the tube axis. Thus the barrier can be formed of thin strip material placed edgewise or flatwise on the dynode or round wire and on the bottom and perhaps on the top of each linear slat dynode.

It should be noted that the dynode barriers shown in FIGS. 1 through 8 extend from opposite corners of the dynode slats while in the embodiment shown in FIGS. 10 through 17 they are placed between the midpoints of the dynode slats. Normally, they cannot be intermixed as the barriers have to be positioned to be axially aligned.

Figure 12:
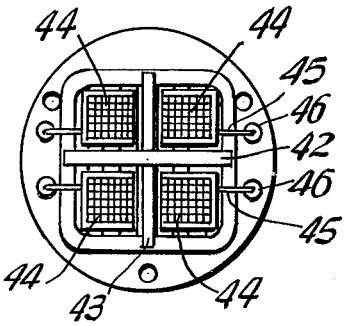
FIG. 12 is a view of a dynode carrying four retarding grids, one for each portion.
Figure 13:
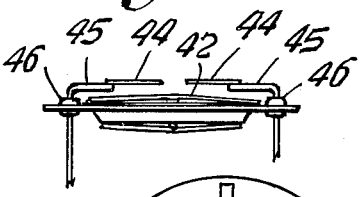
FIG. 13 is an elevation of the dynode and grids of FIG. 12.
Figure 14:
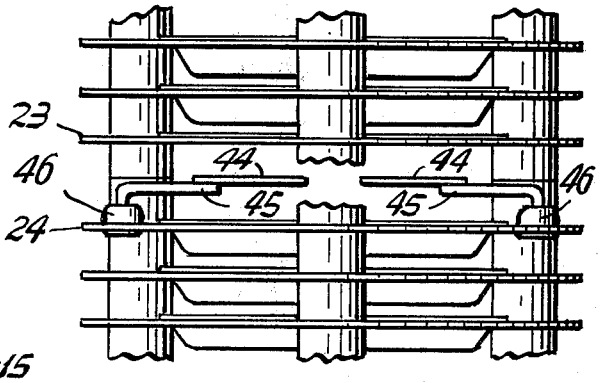
FIG. 14 is a portion of the tube showing the positioning of the dynode and grids relative to the other dynodes.

Single sensing area tubes normally include means for providing gain control to enable calibration of the tube with one such means being a retarding grid to which an adjustable potential is applied. Accordingly, a retarding grid for each portion is thus incorporated into the plural sensing area tube of the present invention to enable calibration of each portion. As shown in FIGS. 12, 13 and 14, the grid for each portion includes a rectangular screen 44 which is supported above the top surface of a dynode by an electrical conducting wire 45 connected therebetween. Each wire is insulated from the dynode as by a glass bead 46 and extends to and through the stem header to enable the potential on each grid to be independently adjustable.

Though the tube of the present invention does not mechanically or physically isolate the electrons of one sensed area from another area, it has been found that if a representative value of impinging material on one area portion is 10 units, a representative value of 7 units would be obtained from its anode portion. The last 3 units are somewhat evenly spread over the other three anode portions. However, this provides a signal strength of 7 to 1 which has been found to be sufficiently within tolerable limits. Additionally, the loss in amplification over that which a single tube would produce has been found to be relatively small and essentially of no consequence when the tube is used in a system. Naturally, if desired, more dynodes may be added to increase the amplification.

As shown in FIG. 14, the grids may be secured to the top of the dynode 24 with the latter being spaced sufficiently from the bottom of the dynode 23 to accommodate the grids.

Figure 15:
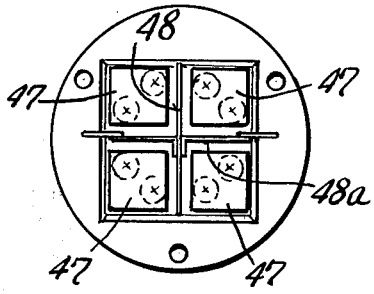
FIG. 15 is a top view of a further embodiment of an anode.
Figure 16:
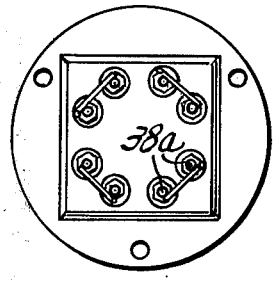
FIG. 16 is a bottom view thereof.
Figure 17:
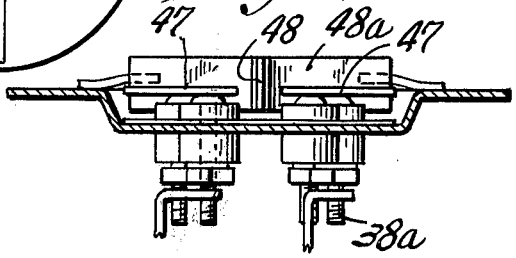
FIG. 17 is a section of the anode shown in FIG. 15, somewhat enlarged.

Shown in FIGS. 15, 16 and 17 is a solid type anode having rectangular, flat, metal anode portions 47 secured on the supports 38. While the anode portions are physically separated, additional separation of the electrons to their own portion may be effected by the use of cross barriers **48, 48*a* that are located edgewise between the anode portions. These barriers may be of the same form as the barriers 31 and 32**.

Figure 18:
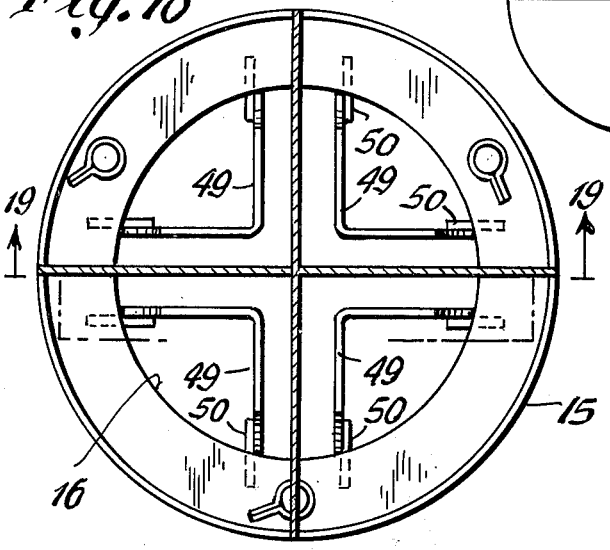
FIG. 18 is a horizontal section of a further embodiment of the tube of the present invention taken essentially on a line corresponding to the line 2—2 of FIG. 2.
Figure 19:
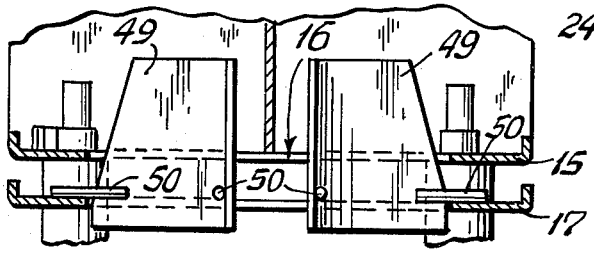
FIG. 19 is a portion of a vertical section taken on the line 19—19 of FIG. 18.

It has also been found desirable to provide an electrostatic field between the photocathode and the first dynode 18 in order to urge the electrons emitted by the photocathode along a path through the opening 16 in the annulus 15 and the spacing ring 17 onto active areas of the first dynode 18. An electrostatic field is formed for each sensing area by providing a focusing element therefor. The elements are identical and the shape which each focusing element 49 may have is shown in FIGS. 18 and 19 and consists of a thin sheet of metal having a right angle cross-section. Each element projects from just slightly below the spacing ring 17 upwardly through the aperture 16 in the annulus 15 and into the chamber. The walls thereof are parallel and slightly spaced from the adjacent portion of the walls 28 and 29. Each element 49 is supported on the ring by short lengths of wire 50 connected to the ring and the element. The spacing ring has a conductor (not shown) that extends through the stem header and enables the ring and elements to be placed at a potential that produces the electrostatic field.

Figure 20:
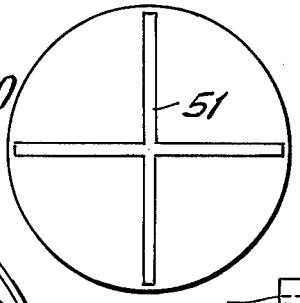
FIG. 20 is a plan view, somewhat reduced in size, of the top of the tube of the present invention.

As with single sensing area tubes, the interior side surface of the glass envelope is coated with aluminum from a location just below the spacing ring to the face 12 of the tube. This surface is also placed at the potential of the spacing ring by being in physical contact with protrusions formed on the peripheral walls of the spacing ring. While the single area tubes did not have any aluminum coating on the sensing face, it has been found preferably to have the aluminum coating extend in crossed thin strips 51 across the interior flat face of the tube as shown in FIG. 20. The strips are slightly wider than the adjacent edges of the walls 28 and 29 and in alignment therewith.

While only a few conducting wires have been shown as extending through the stem header, the tube has a substantial number that extend therethrough. Thus, there is at least one conducting wire for each anode portion, one for each dynode, one for each grid portion, one for the spacing ring 17 and one for the annulus 15. Cutouts are made where needed in the peripheral portions of the dynodes to enable the wires to pass therethrough.

It will accordingly be understood that there has been disclosed a single photomultiplier tube that is capable of sensing matter impinging at a plurality of areas and providing an electrical signal of the quantity of matter in each area. The tube includes many components of a single area tube and the present invention maintains separation of the electron flow for each sensing area as each flows in alignment with the tube axis from the sensing area face to the anode. The separation is achieved by using walls to both subdivide the photocathode material coated sensing face into areas and for providing elongate individual chambers for each area; by using a radial electron dispersing dynode as the first dynode; by using slat orientation between successive dynodes and by having barriers on each dynode. The electron flow for each area is thus directed to its own anode portion where a separate electrical connector to each anode portion enables an electrical signal to be obtained from each portion that is directly related to the quantity of electron flow.

Variations and modifications may be made within the scope of the claims and portions of the improvements may be used without others.

I claim:

1. A plural sensing area photomultiplier tube comprising an envelope having a sensed matter receiving surface coated with photocathode material, a stem header axially aligned with the envelope and spaced from the surface, a plurality of axially aligned dynodes formed into a single unitary stack extending longitudinally along the axis of the tube between the stem header and the surface, the dynode nearest the surface being spaced from the surface, means for subdividing the space between the surface and the nearest dynode into a plurality of chambers aligned along the tube axis with each chamber having its own sensing area of the surface, an opening for leading electron flow from each chamber to the nearest dynode, means for causing each of the plurality of flows of electrons to be passed through the said single stack to be multiplied and including means for maintaining essentially separated each flow of electrons from the other flows of electrons as the flows pass simultaneously through the stack, anode means positioned adjacent the stem header and having a separate anode portion for each sensing area with each anode portion being positioned to receive only one of the flows of electrons exiting from the dynode stack, and an independent electrical connection to each anode portion.

2. The invention as defined in claim 1 in which the means for subdividing includes walls extending from the surface towards the nearest dynode.

3. The invention as defined in claim 2 in which an annulus having a central opening is positioned between the nearest dynode and the surface and in which the walls extend between the annulus and the surface and across the central opening to form the opening leading from each chamber.

4. The invention as defined in claim 3 in which there are two walls extending perpendicularly to each other, with the walls intersecting along the axis of the tube located at the intersection.

5. The invention as defined in claim 3 in which there is an electron focusing element for each opening having a portion extending through its opening into its chamber.

6. The invention as defined in claim 5 in which the portion of each focusing element that projects into the chamber is formed and positioned to be parallel with, but spaced slightly from the walls adjacent thereto.

7. The invention as defined in claim 2 in which there is an aperture formed in the walls to communicate with all chambers for enabling simultaneous distribution of evaporated photocathode material positioned in the aperture into each chamber.

8. The invention as defined in claim 1 in which the nearest dynode is formed of concentric frusto-conical slats.

9. The invention as defined in claim 8 in which the center of the slats coincides with the axis of the tube.

10. The invention as defined in claim 1 in which the means for causing includes barrier means positioned on the bottom surface of at least one dynode.

11. The invention as defined in claim 10 in which the barrier means includes a pair of thin intersecting metallic strips with the intersection coinciding with the axis of the tube.

12. The invention as defined in claim 11 in which the barrier strips are formed of round wire.

13. The invention as defined in claim 11 in which the barrier strips are formed of thin sheet material with the width of the strips being positioned parallel to the axis of the tube.

14. The invention as defined in claim 11 in which the barrier strips are formed of thin sheet material with the width of the strips being perpendicular to the axis of the tube.

15. The invention as defined in claim 11 in which there are additional barrier means positioned on the top surface of at least one dynode.

16. The invention as defined in claim 1 in which at least some dynodes include a plurality of spaced and parallel linear slats that are each angularly inclined towards the stem header and the means for causing includes orienting the slats to have the same angular displacement from one dynode to its sequentially next lower dynode.

17. The invention as defined in claim 10 in which there are at least as many linear slat dynodes as sensing areas, in which the angular displacement is an angle that is equal to one revolution divided by the number of sensing areas and in which the angle extends in the same circular direction from one dynode to the next lower dynode.

18. The invention as defined in claim 17 in which there are four sensing areas, in which the angle is equal to ninety degrees and in which there are at least eight linear slat dynodes.

19. The invention as defined in claim 1 in which each anode portion is positioned to be axially aligned with only one sensing area.

20. The invention as defined in claim 1 in which the means for subdividing and the means for causing have parts that are aligned along the axis of the tube.

21. The invention as defined in claim 20 in which each anode portion is spaced form its adjacent portions and in which the spaces are aligned along the axis of the tube with the parts of the means for subdividing and the means for causing.

22. The invention as defined in claim 1 in which there is a metallic coating formed as narrow strips on the receiving surface, said strips being aligned with the means for subdividing.

23. The invention as defined in claim 1 in which there are means for independently adjusting the flow of electrons in each portion to enable calibration of the flow of electrons in each portion.

24. The invention as defined in claim 23 in which the adjusting means includes a retarding grid for each portion, in which each grid has an extent only within the portion of the tube having its own electron flow, in which the grids are positioned intermediate the stack of dynodes and in which there are electrical conducting means to each grid.

* * * * *